US007084815B2

(12) United States Patent
Phillips et al.

(10) Patent No.: US 7,084,815 B2
(45) Date of Patent: Aug. 1, 2006

(54) DIFFERENTIAL-FED STACKED PATCH ANTENNA

(75) Inventors: James P. Phillips, Lake in the Hills, IL (US); Eric L. Krenz, Crystal Lake, IL (US); Paul W. Reich, Glendale Hts., IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/807,524

(22) Filed: Mar. 22, 2004

(65) Prior Publication Data

US 2005/0206568 A1 Sep. 22, 2005

(51) Int. Cl.
*H01Q 1/38* (2006.01)

(52) U.S. Cl. ..... 343/700 MS; 343/846

(58) Field of Classification Search ..... 343/700 MS, 343/846, 853

See application file for complete search history.

(56) References Cited

U.S. PATENT DOCUMENTS 4,089,003 A * 5/1978 Conroy ..... 343/700 MS
5,442,366 A 8/1995 Sandford
5,515,057 A * 5/1996 Lennen et al. ..... 342/357.06
5,633,646 A * 5/1997 Strickland ..... 343/700 MS
6,114,997 A * 9/2000 Lee et al. ..... 343/700 MS
6,154,175 A * 11/2000 Yee ..... 343/700 MS
6,239,750 B1 * 5/2001 Snygg ..... 343/700 MS
6,556,169 B1 * 4/2003 Fukuura et al. ..... 343/700 MS
6,639,558 B1 * 10/2003 Kellerman et al. .. 343/700 MS
6,717,549 B1 * 4/2004 Rawnick et al. ..... 343/700 MS
6,756,942 B1 * 6/2004 Heyde ..... 343/700 MS
6,885,344 B1 * 4/2005 Mohamadi ..... 343/700 MS

* cited by examiner

*Primary Examiner*—Tan Ho
(74) *Attorney, Agent, or Firm*—Randi L. Karpinia; Daniel C. Crilly; Sylvia Chen

(57) ABSTRACT

An antenna system includes a stacked patch antenna (100) comprising two or more patch antennas symmetrically aligned around an axis. The stacked patch antenna (100) comprises a differential feed patch antenna. The two or more patch antennas include a first patch antenna (105) and a second patch antenna (110). At least a portion of the second patch antenna (110) serves as a ground plane for the first patch antenna (105).

13 Claims, 3 Drawing Sheets

DIFFERENTIAL-FED STACKED PATCH ANTENNA

BACKGROUND OF THE INVENTION

1. Field of the Invention

The present invention is generally related to antennas and more particularly to an antenna for use in an antenna test system.

2. Description of the Related Art

The Cellular Telecommunications and Internet Association (CTIA) operates an equipment testing and certification program to ensure high-quality and reliability of cellular, personal communication services (PCS), enhanced specialized mobile radio (ESMR), and mobile satellite services products. Within this program, the CTIA establishes requirements for spherical-scanning antenna measurement systems (i.e., anechoic chambers). One challenge to antenna testing system designers is meeting the CTIA requirements while maintaining moderate range distances and ceiling heights. To meet the CTIA's antenna measurement system requirements efficiently, a measurement antenna that is low profile, dual-polarized, and multi-band is desired. The antenna preferably has a directive radiation pattern with high symmetry and low taper across the main beam, as well as low cross-polarization levels. It is also desirable that a single antenna assembly be capable of measuring in multiple bands and modes to increase throughput.

Spherical-scanning antenna test systems preferably use test-probe antennas that operate in a single mode of radiation for each desired polarization state and frequency band. Wideband horn antennas tend to change modes of operation over their range of frequencies and are thus not suitable for spherical-scanning antenna test systems. A properly designed probe antenna can provide this single mode of operation but only over a limited frequency band. Therefore, a multiplicity of probe antennas is necessary to cover all frequency bands. This is inconvenient and requires frequent changing of the probe antenna. It is therefore very desirable to have the widest possible band of operation and still maintain the single mode of radiation. It is also desirable to have multiple bands of operation on a single structure.

For spherical-scanning ranges, a probe antenna having a high profile in the direction of radiation will reduce the range distance and consequently degrade measurement certainty; thus, an antenna with a very low profile is desirable.

A stacked patch antenna is a good candidate for this application. Single-ended-fed ("single-fed") stacked patch antennas are well-known in antenna literature as an approach for broad band or multi-band operation. However, to obtain bandwidths typically required for a spherical-scanning test system application, the patch antenna height is required to be large relative to the heights of single-fed patch antennas of the known art. At such height, a single-fed implementation suffers pattern asymmetry and increased cross-polarization. The high-frequency element of the antenna pattern is also more susceptible to diffraction/reflection effects from the low-frequency ground plane, which may cause ripple in the pattern peak. Such pattern ripple increases the difficulty in satisfying the CTIA requirements.

BRIEF DESCRIPTION OF THE DRAWINGS

The accompanying figures, where like reference numerals refer to identical or functionally similar elements throughout the separate views and which together with the detailed description below are incorporated in and form part of the specification, serve to illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but rather should be interpreted merely as a basis for the claims and as a representative basis for teaching one skilled in the art to variously employ the present invention in virtually any appropriately detailed structure. Further, the terms and phrases used herein are not intended to be limiting; but rather are intended to provide an understandable description of the invention.

The terms "a" or "an," as used herein, are defined as one or more than one. The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The terms "program," "software application," and the like, as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library and/or other sequence of instructions designed for execution on a computer system.

The present invention utilizes one or more patch antennas with a large height and air for the dielectric to get a large, single-mode bandwidth of operation in a light-weight structure. The one or more patch antennas are "fed" differentially at two symmetrical points to ensure that only one mode of radiation exists for each of the two orthogonal linear polarizations supported by the patch antenna. In accordance with the present invention, the frequency of operation for each patch antenna is arbitrarily selected. A centrally located, fully grounded conduit is used which allows independent transmission lines to be run to the upper patches. In one embodiment of the present invention, all of the switching and control hardware is integrated onto a micro strip printed circuit board. Multi-band, dual-polarized probe antennas include significant circuitry to be able to connect each of the antenna capabilities to the output connectors on demand. By integrating the circuitry into the patch antenna structure, all of the antenna's capability may be available by using control signals from the transmission lines used to connect the probe antennas to the instrumentation.

Figure 1:
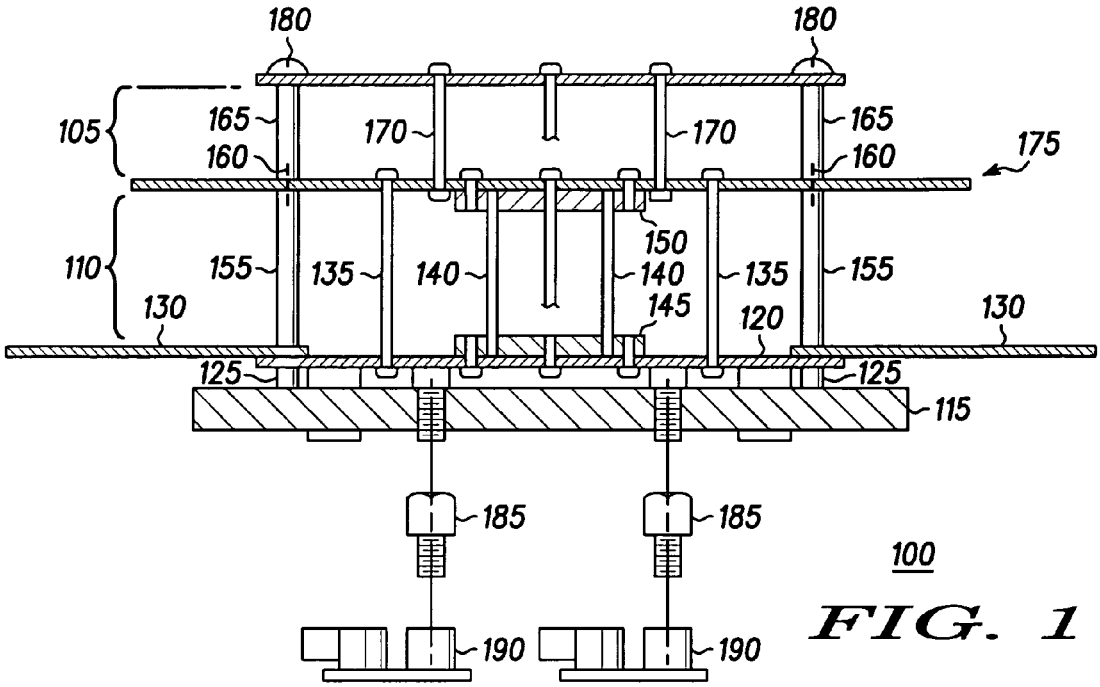
FIG. 1 is a cross sectional view of a stacked patch antenna.

FIG. 1 is a cross sectional view of one embodiment of a differential-fed stacked patch antenna 100 in accordance with the present invention. The stacked patch antenna 100 preferably comprises two or more patch antennas that are superimposed. If X and Y axes define the plane in which the bottom-most patch antenna's ground plane lies, and the Z axis lies in the direction of displacement of the patch element from the ground plane, the successive patches are arrayed along the Z axis relative the bottom-most patch (i.e., symmetrically aligned around the Z-axis). Preferably, the patch element of a lower patch antenna in the stack also serves as the ground plane element for the next higher patch antenna in the stack.

Accordingly, and as illustrated, the stacked patch antenna 100 comprises a first patch antenna 105 and a second patch antenna 110. The first patch antenna 105 preferably is a high frequency patch antenna which is frequency sensitive. The second patch antenna 110 preferably is a lower frequency patch antenna and is also frequency sensitive. The first patch antenna 105 and the second patch antenna 110 thus are determined by the frequency of operation and are further related in frequency to each other. Further, each of the frequencies of operation can be arbitrarily selected. Preferably, the first patch antenna 105 and the second patch antenna 110 are comprised of a large height and air dielectric to get a large, single-mode bandwidth of operation in a light-weight structure.

Figure 2:
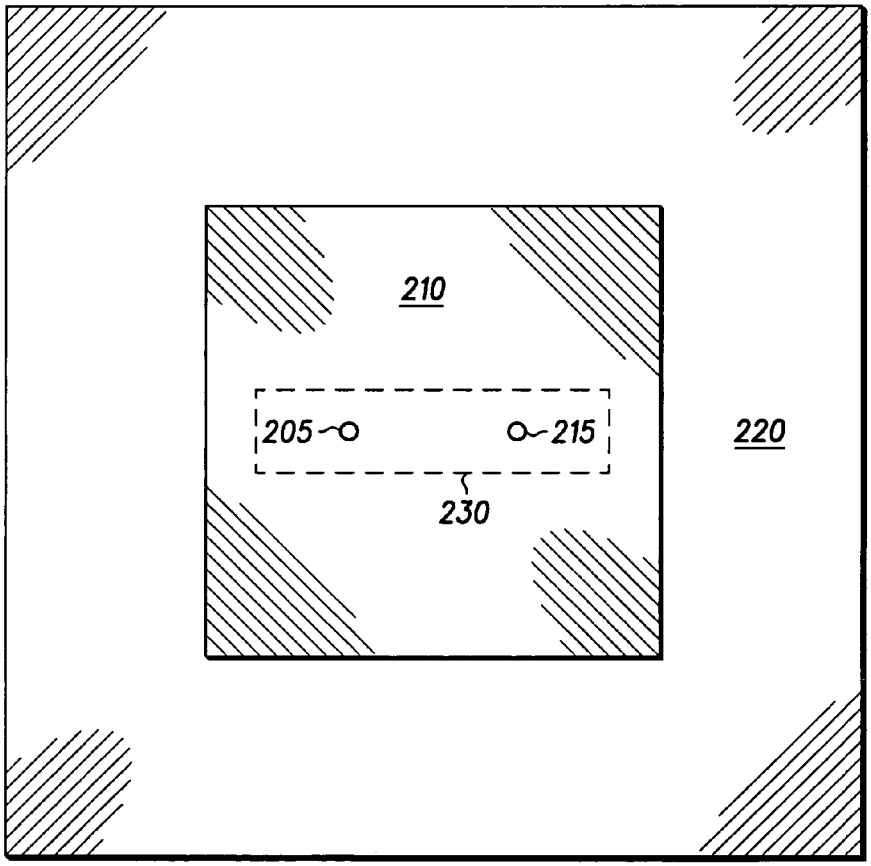
FIGS. 2 and 3 are top plan views of various embodiments of a patch antenna.

FIG. 2 illustrates one embodiment of a patch antenna for use in accordance with the present invention. As an example, the patch antenna can be the first patch antenna 105 and/or the second patch antenna 110 of FIG. 1. Specifically, FIG. 2 is a top plan view of a single-polarization, differential feed patch antenna 200. As illustrated in FIG. 2, the single-polarization, differential feed patch antenna 200 comprises a grounded substrate 220; a radiating system 210 carried, supported by, or suspended over the grounded substrate 220, and a feed system 230 having two feed points 205, 215. The grounded substrate 220, for example, can be formed by a layer of dielectric material and a layer of conductive material that functions as a ground plane. In one embodiment, the dielectric material used is an alumina substrate, which has a dielectric constant of approximately ten (10). Alternatively, the dielectric material may be air, as described above. The feed system 230 can include a micro strip line disposed beneath the ground plane of the grounded substrate 220. Preferably, the feed points 205,215 of the feed system 230 are each comprised of a coaxial feed rod coupled to the micro strip line to provide a conduit for communication signals. The feed points 205, 215, in accordance with one embodiment of the present invention, are structurally located along the same axis (i.e., in a straight line) with relation to each other.

As is known in the art, the radiating system 210 can include a patch radiator that forms a resonating structure when excited by a feed signal. The patch radiator is preferably rectangular in geometry, having a length measured in a direction of wave propagation (herein referred to as "resonating length") and a width measured perpendicular to the resonating length. For dual-polarization implementations, a square patch element provides two orthogonal linear polarizations. Those of ordinary skill in the art will recognize that shapes other than a square (for example, a circle) can also be employed to support the desired modes of operation in accordance with the present invention.

Figure 3:
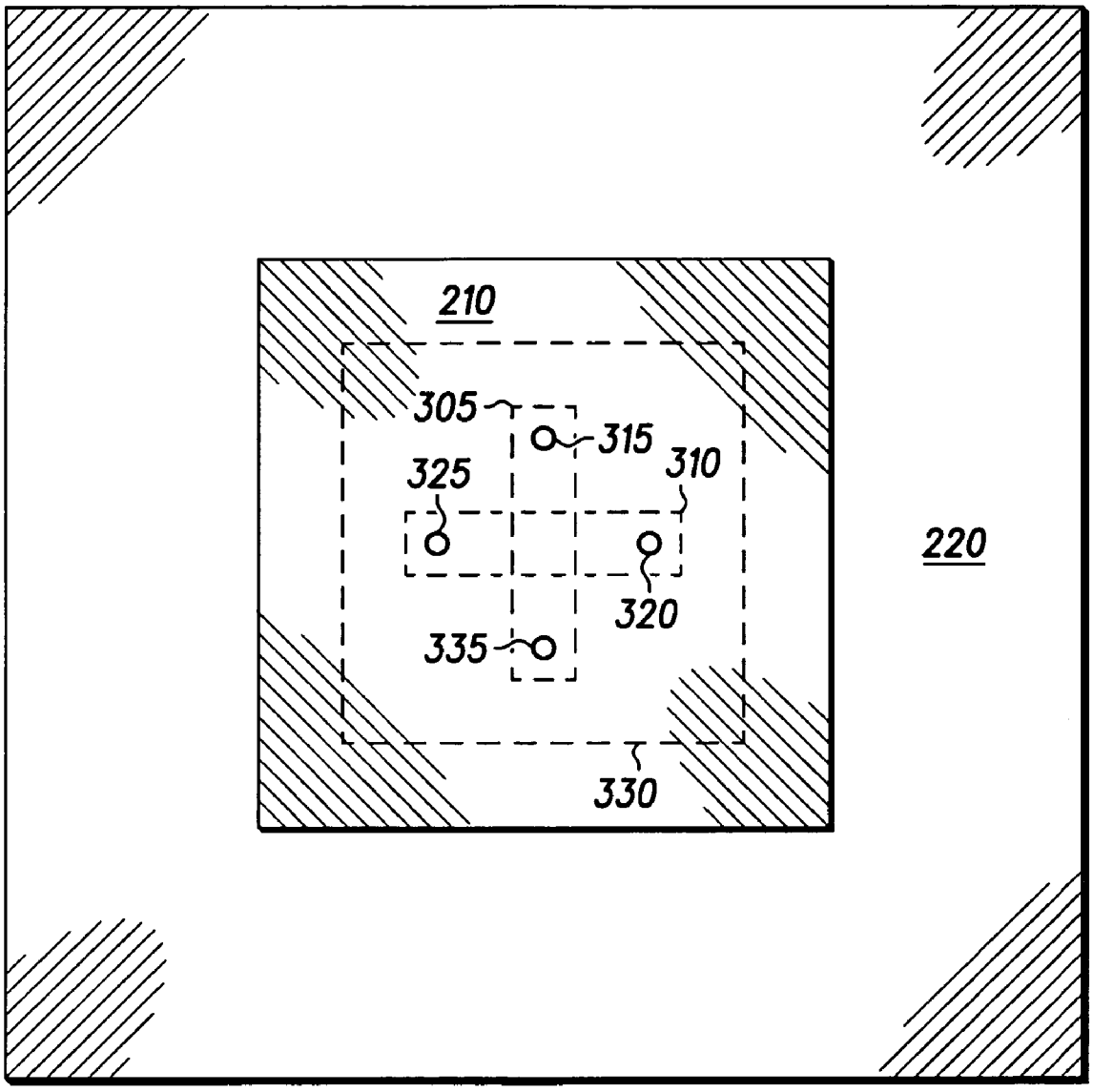

FIG. 3 illustrates an alternate embodiment of a patch antenna for use in accordance with the present invention. As an example, the patch antenna can be the first patch antenna 105 and/or the second patch antenna 110 of FIG. 1. Specifically, FIG. 3 is a top plan view of a dual-polarization, differential feed patch antenna 300. As illustrated in FIG. 3, the dual-polarization, differential feed patch antenna 300 comprises a grounded substrate 220, a radiating system 210 carried or supported by the grounded substrate 220, and a feed system 330 comprised of two pairs 305, 310 of feed points (315, 335 and 325, 320 respectively). As illustrated, the two pairs 305, 310 of feed points are preferably orthogonally located with respect to each other. Preferably, the feed points 315, 320, 325, 335 are each comprised of a coaxial feed rod coupled to the micro strip line to provide a conduit for communication signals.

Referring back to FIG. 1, the stacked patch antenna 100 further comprises a plate 115 for mounting the entire assembly of the stacked patch antenna 100 and providing rigidity to the structure. A control circuit board 120 is mechanically located at a fixed distance from the plate 115 using one or more lower spacers 125. One or more ground planes 130 are electrically and mechanically coupled to the control circuit board 120. The ground planes 130 serve as an earth ground or reference for the stacked patch antenna 100. One or more feed rods 135 couple the control circuit board 120 to a circuit board 175 located between the first patch antenna 105 and the second patch antenna 110. The circuit board 175 serves as both the radiating patch element for the second patch antenna 110 and the ground plane element of the first patch antenna 105. The control circuit board 120 preferably includes all of the switching and control hardware integrated onto a micro strip printed circuit board. Multi-band, dual-polarized probe antennas include significant circuitry to be able to connect each of the antenna capabilities to the output connectors on demand. By integrating the circuitry, all of the capability may be available by using control signals from the transmission lines used to connect the probe antennas (i.e., the stacked patch antenna 100) to the instrumentation. One or more coaxial cable feed lines 140 electrically couple the control circuit board 120 to the circuit board 175. These coaxial cables 140 carry the feed signal(s) to the first patch antenna 105. The circuit board 175 distributes the signal(s) from the coaxial cable feed lines 140 to one or more feed rods 170. The feed rods 135 and the coaxial cable feed lines 140 connect the second and first patch antennas 110 and 105, respectively, to the transceiver circuitry located within the control circuit board 120 to transfer radio-frequency (RF) energy between the two elements. Preferably, the coaxial cable feed lines 140 are comprised of coaxial cable. To provide mechanical rigidity, a control circuit side bushing 145 and a patch antenna side bushing 150 are coupled to shield conductors on opposing ends of the coaxial cable feed lines 140. One or more middle spacers 155 provide further mechanical support to locate the circuit board 175 at a fixed distance from the plate 115. One or more nylon studs 160 are located within the middle spacers 155 to mechanically support the circuit board 175. The patch element of the first patch antenna 105 is located at a fixed distance above the circuit board 175 using one or more top spacers 165: One or more nylon screws 180 connected to the spacers 165 through the first patch antenna 105 hold the entire assembly of the stacked patch antenna 100 together. Communication signals to the stacked patch antenna 100 are coupled through one or more SMA/SMB adapters 185 and one or more blind mate adapters 190.

Figure 4:
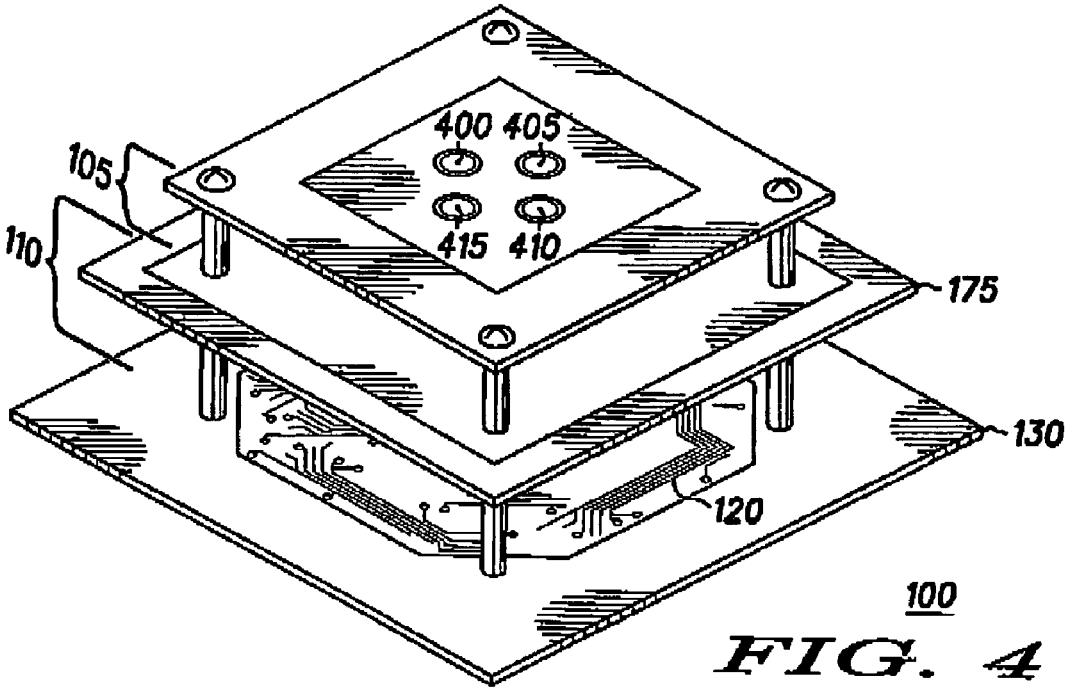
FIG. 4 is an isometric view from the top of a stacked patch antenna.

FIG. 4 is an isometric view from the top of one embodiment of the stacked patch antenna 100. As illustrated in FIG. 4, the first patch antenna 105 and the second patch antenna 110 are preferably differentially fed through the center of the stacked patch antenna 100 which is a zero potential point. This permits connection of the coaxial cable feed lines 140 without disturbing the desired field distributions of the second patch antenna 110.

As is known by those of ordinary skill in the art, a differential feed arrangement is one in which a structure is excited by two signals which have the same amplitude, but a (nominal) 180-degree difference in phase. This contrasts with a single-ended feed, in which a sincture is excited by only a single signal referenced to ground. A common means of implementing a differential feed is to split the excitation RF (radio frequency) signal (for example, with a 3-dB splitter) and then to apply an additional 180-degree phase shift to only one of the splitter outputs. This yields two RF signals, referenced to ground, with identical amplitudes, but a relative phase shift of 180 degrees. Such a signal-splitting, phase-shifting approach is sometimes implemented as a single circuit operation using a 180-degree hybrid. The two signals are ten applied to two appropriate feed points on the structure, as defined for the desired structural mode to be excited.

In accordance wit the present invention, for each polarization, these two feed points lie on a centerline of the patch etement and are symmetrically located on that centerline about the patch element's centroid (i.e., a center point). The distance of the feed points from the centroid is adjusted so as to achieve the desired impedance match at the frequency of operation. Since the present invention often is desired to provide two orthogonal polarizations from one structure, a second polarization is excited on the square patch structure, using an identical differential pair of feeds rotated geometrically 90 degrees about the patch centroid relative to the first polarization's feeds, so as to lie on the patch's other centerline.

Each of the first patch antenna 105 and the second patch antenna 110 are "fed" differentially at two symmetrical points to ensure that only one mode of radiation exists for each of the two orthogonal linear polarizations supported by the patch antenna (e.g., as illustrated in FIG. 2 previously herein). In a preferred embodiment, the first patch antenna 105 is differentially fed using four feeds (400, 405, 410, and 415) as two pairs (400, 410 and 405, 415), such as illustrated in FIG. 3 previously herein. Each pair (400, 410 and 405, 415) provides separate linear excitations. The second patch antenna 110 is similarly differentially fed using four feed rods 135, similarly arranged as pairs, not visible in FIG. 4. The pairs, as illustrated, preferably are located as pairs on a clock face (e.g., at 12 and 6, and at 3 and 9). The present invention further utilizes a centrally located, fully grounded conduit, comprising the shield conductors of the coaxial cables 140, that allows independent transmission lines to be run to the upper patches (e.g., first patch antenna 105). Because this grounded conduit passes through the center of the second patch antenna 110, which is a zero-potential point in the desired mode(s) of operation of the second patch antenna 110, it does not significantly disturb the second patch antenna's operation.

The structure described thus far supports two orthogonal linear polarizations in each frequency band (patch element). Additionally, the two beginning RE signals corresponding to their respective linear polarizations can be further manipulated to yield two mathematically orthogonal circular polarization states (right-hand-circularly-polarized and left-hand-circularly-polarized, or RHCP and LHCP) from the same structure. This is done by applying a + or −90 degree phase shift to the two base RF signals, before they are each further split and shifted 180 degrees to form differential feeds. In practice, this is often done using a 90-degree hybrid, so that RHCP (fight hand circular polarization) and LHCP (left hand circular polarization) are simultaneously available from the antenna system. Hence, each of the patch antennas 105 and 110 can further provide the two circular polarization states, RHCP and LHCP. As an example, one or both patch antennas preferably are dual-polarized. The two linear polarizations' signals for a patch element are combined to give circular polarization. In the embodiment in which each patch antenna has four feed points grouped by twos into two pairs (i.e., two differential feeds—one differential feed pair per linear polarization), the two differential feed pairs can be further manipulated to produce two circular polarization feed signals. It will be appreciated by those of ordinary skill in the art that the entire hierarchy can be repeated for the other patch antenna.

Figure 5:
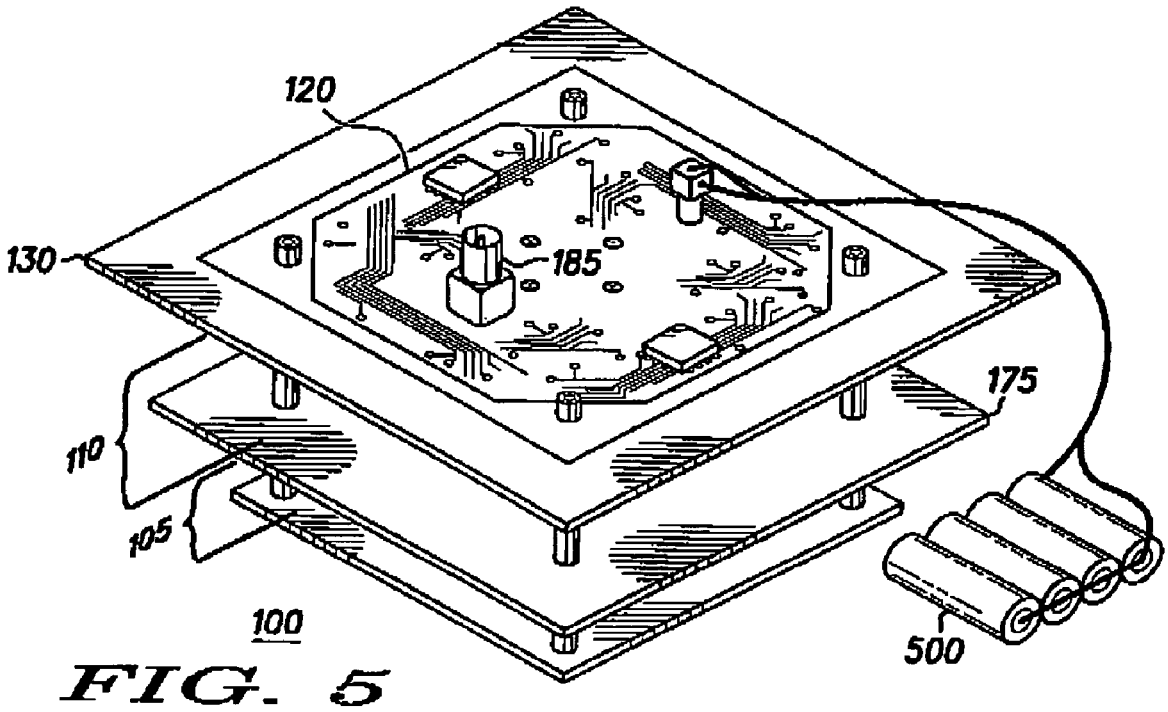
FIG. 5 is an isometric view from the bottom of a stacked patch antenna.

FIG. 5 is an isometric view from the bottom of one embodiment of the stacked patch antenna 100. As illustrated, the ground planes 130 are preferably comprised of a single piece of copper plating to provide a consistent ground reference. The control circuit board 120 is coupled both electrically and mechanically to the ground planes 130 as previously described herein. A battery 500, a DC bias voltage applied through the transmission lines connecting the probe antenna to the instrumentation, or some other fixed power supply provides power to the control circuit board 120 for operation.

The stacking of two patch elements permits multi-band coverage with a very low physical profile to reduce the impact on range length. The use of a differential feed for each mode/element maintains high pattern symmetry and excellent cross-polarization characteristics across the entire operating band of each element. It also substantially reduces the impact of the low-frequency ground plane on the high-frequency element's pattern. Routing the high-frequency element feed lines through the low-frequency element's zero-potential point allows band/polarization switching and connecting to be simplified.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. An antenna system comprising:

a grounded substrate;

a first differential feed patch antenna that includes a first radiating system coupled to the grounded substrate and a first feed system having two feed points for providing a first differential feed signal, wherein the first radiating system resonates in response to an excitation by the first differential feed signal; and a second differential feed patch antenna being separated from the first differential feed patch antenna by a first distance, the second differential feed patch antenna including a second radiating system coupled to the grounded substrate and a second feed system having two feed points for providing a second differential feed signal, wherein the second radiating system resonates in response to an excitation by the second differential feed signal, wherein at least a portion of the second differential feed patch antenna serves as a ground plane for the first differential feed patch antenna, and wherein the first radiating system resonates at a higher frequency than the second radiating system.

2. The antenna system as recited in claim 1, wherein the two feed points of the first feed system are located around a center point and wherein the center point comprises a zero potential point.

3. The antenna system as recited in claim 2, wherein each of the feed points of the first feed system is a coaxial feed rod.

4. The antenna system as recited in claim 2, wherein the feed points of the second feed system are located around the center point.

5. The antenna system as recited in claim 4, wherein each of the feed points of the second feed system is a coaxial feed rod.

6. An antenna system comprising:

a grounded substrate;

a first differential feed patch antenna that includes a first radiating system coupled to the grounded substrate and a first feed system having two or more pairs of first feed points, wherein the two or more pairs of first feed points provide two or more first differential feed signals, and wherein the first radiating system resonates in response to an excitation by the two or more differential feed signals;

a second differential feed patch antenna being separated from the first differential feed patch antenna by a first distance, the second differential feed patch antenna including a second radiating system coupled to the grounded substrate and a second feed system having two or more pairs of second feed points, wherein the two or more pairs of second feed points provide two or more second differential feed signals, and wherein the second radiating system resonates in response to an excitation by the two or more second differential feed signals;

wherein at least a portion of the second differential feed patch antenna serves as a ground plane for the first differential feed patch antenna and wherein the first radiating system resonates at a higher frequency than the second radiating system.

7. The antenna system as recited in claim 6, wherein the two or more pairs of first feed points are orthogonally located with respect to each other.

8. The antenna system as recited in claim 7, wherein the two or more first differential feed signals are further combined in phase quadrature to yield a first pair of circular polarized signals.

9. The antenna system as recited in claim 8, wherein the two or more pairs of second feed points are orthogonally located with respect to each other.

10. The antenna system as recited in claim 9, wherein the two or more second differential feed signals are further combined in phase quadrature to yield a second pair of circular polarized signals.

11. An antenna system comprising:

a plurality of differential feed patch elements symmetrically aligned about a first axis, a first patch element of the plurality of differential feed patch elements operable to radiate at a first frequency responsive to at least a first differential pair of excitation signals, a second patch element of the plurality of differential feed patch elements being separated from the first patch element by a first distance and operable to radiate at a second frequency responsive to at least a second differential pair of excitation signals, the second frequency being lower than the first frequency;

a ground plane symmetrically aligned about the first axis and separated from the plurality of differential feed patch elements by a second distance; and a feed system operable to supply the first differential pair of excitation signals and the second differential pair of excitation signals to the plurality of patch elements.

12. The antenna system as recited in claim 11, wherein the feed system is operable to split a first excitation signal at the first frequency into a first pair of excitation signals each having an equal amplitude and to apply a phase shift of 180 degrees to one of the first pair of excitation signals to produce the first differential pair of excitation signals, and wherein the feed system is further operable to split a second excitation signal at the second frequency into a second pair of excitation signals each having an equal amplitude and to apply a phase shift of 180 degrees to one of the second pair of excitation signals to produce the second differential pair of excitation signals.

13. The antenna system of claim 12, wherein the feed system is further operable to supply a third excitation signal at the first frequency, apply a phase shift of 90 degrees to the third excitation signal relative to a phase of the first excitation signal to produce a quadrature excitation signal, split the quadrature excitation signal into a third pair of excitation signals each having an equal amplitude, and apply a phase shift of 180 degrees to one of the third pair of excitation signals to produce a third differential pair of excitation signals; and wherein the feed system is further operable to supply the first differential pair of excitation signals and the third differential pair of excitation signals to the first patch element at two orthogonal pairs of feed points, the first pair of feed points operable to receive the first differential pair of excitation signals and being positioned symmetrically about a centroid of the first patch element along a second axis, the second pair of feed points operable to receive the third differential pair of excitation signals and being positioned symmetrically about the centroid of the first patch element along a third axis, the first axis, the second axis and the third axis being orthogonal to each other, the first differential pair of excitation signals and the third differential pair of excitation signals collectively forming a circularly polarized excitation signal.

* * * * *